US005731552A

United States Patent [19]

Tsao

[11] Patent Number: 5,731,552

[45] Date of Patent: Mar. 24, 1998

[54] SPEAKER SYSTEM WITH SOUND ABSORBING DIAPHRAGM

[76] Inventor: Ye-Ming Tsao, 6-4 Fl., No. 188, Sec. 3, Ting-Chou Rd., Taipei, Taiwan

[21] Appl. No.: 650,986

[22] Filed: May 21, 1996

[51] Int. Cl.[6] ..... H05R 5/00

[52] U.S. Cl. ..... 181/156; 181/146

[58] Field of Search ..... 181/144, 146, 181/147, 151, 156, 160, 199

[56] References Cited

U.S. PATENT DOCUMENTS

| | | | |
|---|---|---|---|
| 3,780,824 | 12/1973 | Prince | 181/144 |
| 4,076,097 | 2/1978 | Clarke | 181/156 X |
| 4,953,655 | 9/1990 | Furukawa | 181/156 X |
| 5,012,889 | 5/1991 | Rodgers | 181/144 X |
| 5,150,417 | 9/1992 | Stahl | 181/156 X |
| 5,197,103 | 3/1993 | Hayakawa | 181/156 X |
| 5,373,564 | 12/1994 | Spear et al. | 181/156 X |

*Primary Examiner*—Khanh Dang
*Attorney, Agent, or Firm*—Bacon & Thomas

[57] ABSTRACT

Interference between sound waves of different frequencies in a speaker system having a woofer and associated transmission tube are eliminated by securing a sound absorbing diaphragm to the output end of the tube to absorb sharp and high frequency sound waves while permitting low frequency sound waves to be transmitted through the diaphragm.

2 Claims, 1 Drawing Sheet

SPEAKER SYSTEM WITH SOUND ABSORBING DIAPHRAGM

BACKGROUND OF THE INVENTION

The present invention relates to speaker systems, and relates more particularly to the woofer transmission tube of a speaker system which is covered with a sound absorbing diaphragm at its output end to attenuate sharp and high frequency sound waves and permit low frequency sound waves to be driven out of the tube.

In order to prevent interference between sound waves of different frequencies, equalizers may be installed in a speaker to treat acoustic signals of different frequencies. Alternatively, speakers of different ranges may be used and installed in a cabinet to increase the sound of different frequencies. Regular speaker systems include two types, namely, the enclosed type and the lower frequency transmission type. In an enclosed type speaker system, the drive unit of each speaker is enclosed, and sound is driven out of each speaker from its front side. In a low frequency transmission type speaker system, the phase of the sound from the back side of the woofer is reversed and then directed out of the cabinet through a transmission tube which defines an acoustic path. The hole of the path may be designed in the form of an open hole, or a passive speaker may be provided. In an open hole design, the phase of the back side sound of the woofer is adjusted to approximately equal to the front side voice, a difference of about 180 degrees. Because this design can only reverse 180 degrees of the back side sound of the woofer of a fixed frequency, the sound waves of the front side sound of the woofer tend to interfere with the reflected sound waves, thereby causing a mixed sound to be produced. In a passive speaker design, an oscillating diaphragm is mounted on the reflecting hole to shift back the reflected sound, causing it to be added to the front side sound of the woofer. However, the oscillating diaphragm has a rigid center body which produces resonance that interferes with the reflected sound. Furthermore, because the hole is small, a passive speaker tends to transmit high frequency sound waves to the outside of the speaker and which further adversely affect the performance of the woofer.

SUMMARY OF THE INVENTION

The present invention overcomes the aforementioned problems. It is the main object of the present invention to provide a speaker system which eliminates high frequency sound waves from interfering with the low frequency sound waves of the woofer. According to the present invention, the speaker system provides a sound absorbing diaphragm on the output end of the woofer transmission tube to absorb sharp and high frequency sound waves and permit low frequency sound waves to transmit through the output end of the woofer transmission tube.

DETAILED DESCRIPTION OF THE PREFERRED EMBODIMENT

Figure 1:
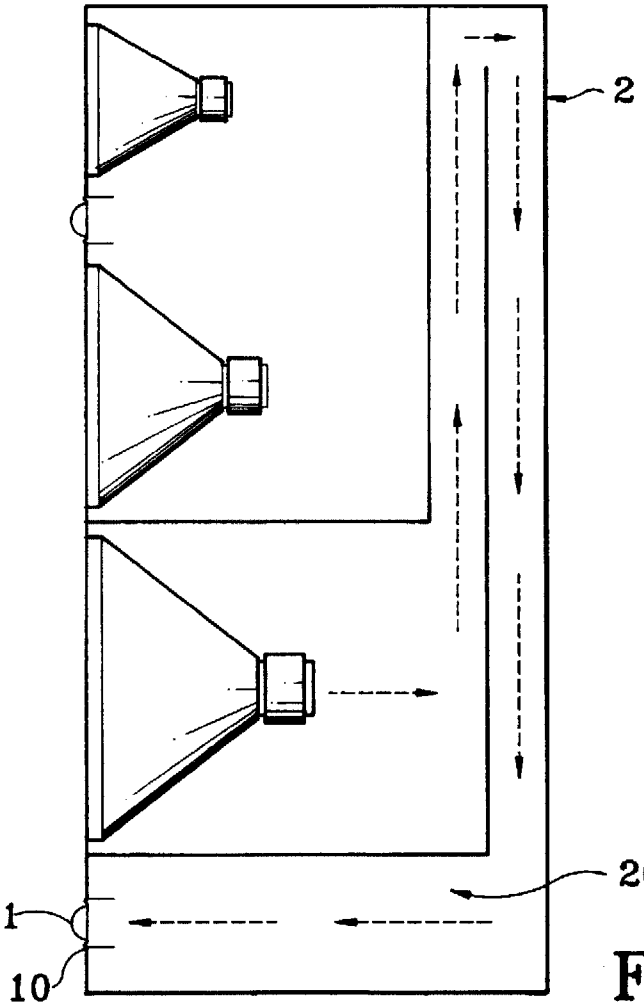
FIG. 1 is a cross-sectional view of a speaker system according to the present invention, showing the sound absorbing diaphragm fastened to the output end of the woofer transmission tube.

Referring to FIG. 1, a sound absorbing diaphragm 1 is fastened to the output end 10 of a woofer transmission tube 20 of a speaker system 2. The diaphragm 1 absorbs and attenuates reflected sharp and high frequency sound waves, and also extraneous noises, harmonics and air flow sound. The diaphragm 1 is preferably made from flexible, soft and light material. For example, the diaphragm 1 may be made from foam plastic stamped into the desired shape. When sharp and high frequency sound waves are transmitted by the tube 20 toward the output end 10, the waves do not drive diaphragm 1 to oscillate, but will instead be absorbed by diaphragm 1. According to tests, low frequency sound waves are effectively transmitted through diaphragm 1 without being attenuated.

Figure 2:
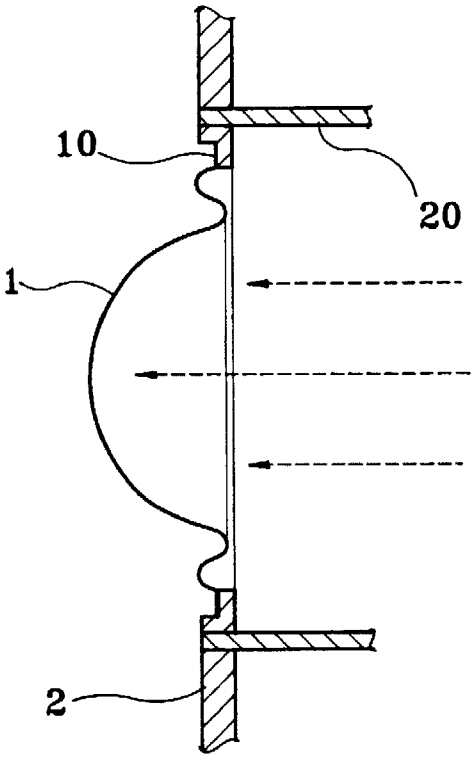
FIG. 2 is a cross-section on an enlarged scale of a part of FIG. 1, showing the corrugated cross-sectional configuration of the sound absorbing diaphragm.

FIG. 2 is a cross-sectional view showing the sound absorbing diaphragm 1 installed in the output end 10 of the woofer transmission tube 20 inside the cabinet 2. The diaphragm 1 preferably has a smoothly arched cross-section that curves outwardly, and an annular flange around its periphery fastened to the periphery of the output end 10 of the woofer reflecting tube 20. In FIG. 2, diaphragm 1 is shown having a substantially corrugated cross-sectional configuration.

I claim:

1. A speaker system comprising a cabinet, a woofer and a transmission tube disposed within the cabinet, the transmission tube including an input end for receiving sound waves from the woofer and an output end for directing sound waves out of the cabinet, a sound absorbing diaphragm covering the output end of the tube for absorbing high frequency sound waves while permitting low frequency sound waves to transmit through the diaphragm, and the diaphragm having a substantially corrugated cross-sectional configuration.

2. The speaker system of claim 1 wherein the sound absorbing diaphragm is made of foam plastic material stamped into the corrugated configuration.

* * * * *